US005629504A

United States Patent [19]

Chang

[11] Patent Number: 5,629,504

[45] Date of Patent: May 13, 1997

[54] VOLTAGE SWITCH

[75] Inventor: Chun-Yun Chang, I-Lan Hsien, Taiwan

[73] Assignee: Solteam Electronics Co., Ltd., I-Lan Hsien, Taiwan

[21] Appl. No.: 557,237

[22] Filed: Nov. 14, 1995

[51] Int. Cl.[6] ..... H01H 15/02

[52] U.S. Cl. ..... 200/16 C; 200/303

[58] Field of Search ..... 200/16 R–16 F, 200/293, 294–302.3, 303, 304, 305, 306, 307

[56] References Cited

U.S. PATENT DOCUMENTS

| | | | |
|---|---|---|---|
| 3,158,698 | 11/1964 | Campbell | 200/16 C |
| 3,757,060 | 9/1973 | Ianuzzi et al. | 200/16 C |
| 3,996,431 | 12/1976 | Brown | 200/16 C |
| 4,185,176 | 1/1980 | Matsuo | 200/16 D |
| 4,341,935 | 7/1982 | Josemans | 200/16 C X |
| 5,049,707 | 9/1991 | Kameya | 200/16 D |

*Primary Examiner*—J. R. Scott
*Attorney, Agent, or Firm*—Bacon & Thomas

[57] ABSTRACT

A voltage switch including a casing, a plurality of terminals fastened to the casing, a bottom board covered on the casing and having a center opening, a contact slide mounted in the casing and moved within the center opening of the bottom board to alternatively connect the terminals together,, wherein the casing has a plurality of mounting grooves symmetrically disposed at two opposite sides; the bottom board is stamped from a metal plate and then bent into shape, having two screw holes longitudinally alinged at two opposite ends for mounting, and a plurality of upright hooks symmetrically and transversely aligned at two opposite ends and respectively fastened to the mounting grooves of the casing.

2 Claims, 3 Drawing Sheets

VOLTAGE SWITCH

BACKGROUND OF THE INVENTION

The present invention relates to voltages switches, and relates more particularly to such a voltage switch which is inexpensive to manufacture, and easy to assemble.

An electric or electronic apparatus may be equipped with a voltage switch so that the apparatus can be adapted to alternatively receive different AC voltages. Various voltage switches have been disclosed, and intensively used in electric and electronic apparatus. However, there are critical requirements on the specifications of voltage switches in most countries in the world, for example, the requirement for withstand voltage between the terminal contact and the ground contact in Germany is 3,000 VAC/1 minute. Conventionally, plastics and bakelite are commonly used for making the bottom boards of regular voltage switches, and copper nuts are used and fixedly secured to the plastic or bakelite bottom boards of regular voltage switches for mounting. However, plastic and bakelite bottom boards cannot effectively protect the interference of magnetic waves, and the use of bakelite and copper nuts greatly increase the manufacturing cost of the voltage switch.

SUMMARY OF THE INVENTION

The present invention has been accomplished to provide a voltage switch which eliminates the aforesaid drawbacks. According to the preferred embodiment of the present invention, the voltage switch comprises a casing, a plurality of terminals fastened to the casing, a bottom board covered on the casing and having a center opening, a contact slide mounted in the casing and moved within the center opening of the bottom board to alternatively connect the terminals together, wherein the casing has a plurality of mounting grooves symmetrically disposed at two opposite sides; the bottom board is stamped from a metal plate and then bent into shape, having two screw holes longitudinally alinged at two opposite ends for mounting, and a plurality of upright hooks symmetrically and transversely aligned at two opposite ends and respectively fastened to the mounting grooves of the casing.

DETAILED DESCRIPTION OF THE PREFERRED EMBODIMENT

Figure 1:
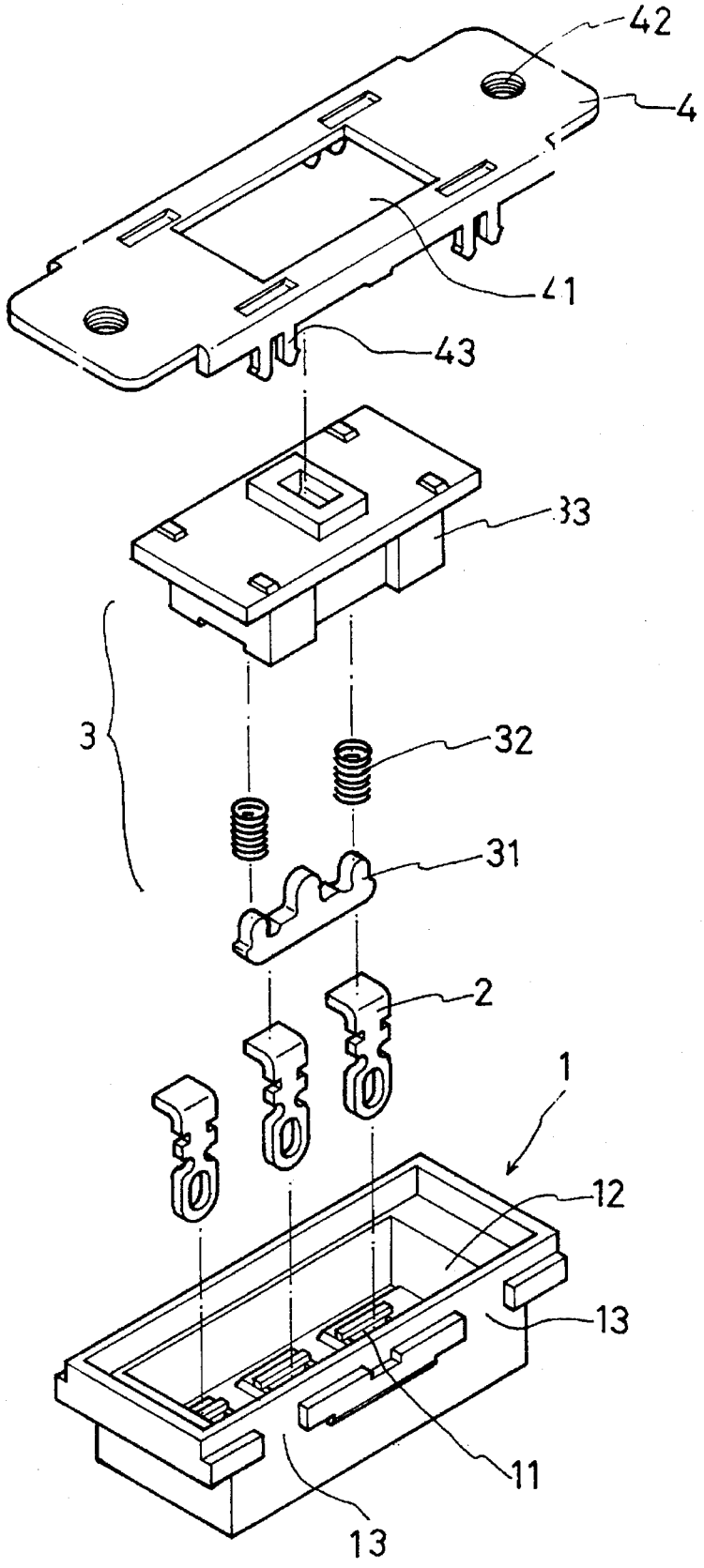
FIG. 1 is an exploded view of a voltage switch according to the present invention.

Referring to FIG. 1, a voltage switch in accordance with the present invention is generally comprised of a casing 1, a plurality of terminals 2, a contact slide 3, and a bottom board 4. The casing 1 comprises an open chamber 12, which receives the contact slide 3, a plurality of terminal slots 11 in communication with the open chamber 12 for mounting the terminals 2 respectively, and a plurality of mounting grooves 13 symmetrically disposed at two opposite sides for mounting the bottom board 4. The terminals 2 are respectively fastened to the terminal slots 11 and partially protruding out of the casing 1. The contact slide 3 comprises a metal contact plate 31, a slide body 33, and a plurality of springs 32 connected between the metal contact plate 31 and the slide body 33. The bottom board 4 is made from metal by a stamping process, having a center opening 41, which defines the sliding distance of contact slide 3, two mounting screw holes 42 at two opposite ends, and a plurality of upright hooks 43 symmetrically disposed at two opposite ends and respectively fastened to the mounting grooves 13 of the casing 1.

Figure 2:
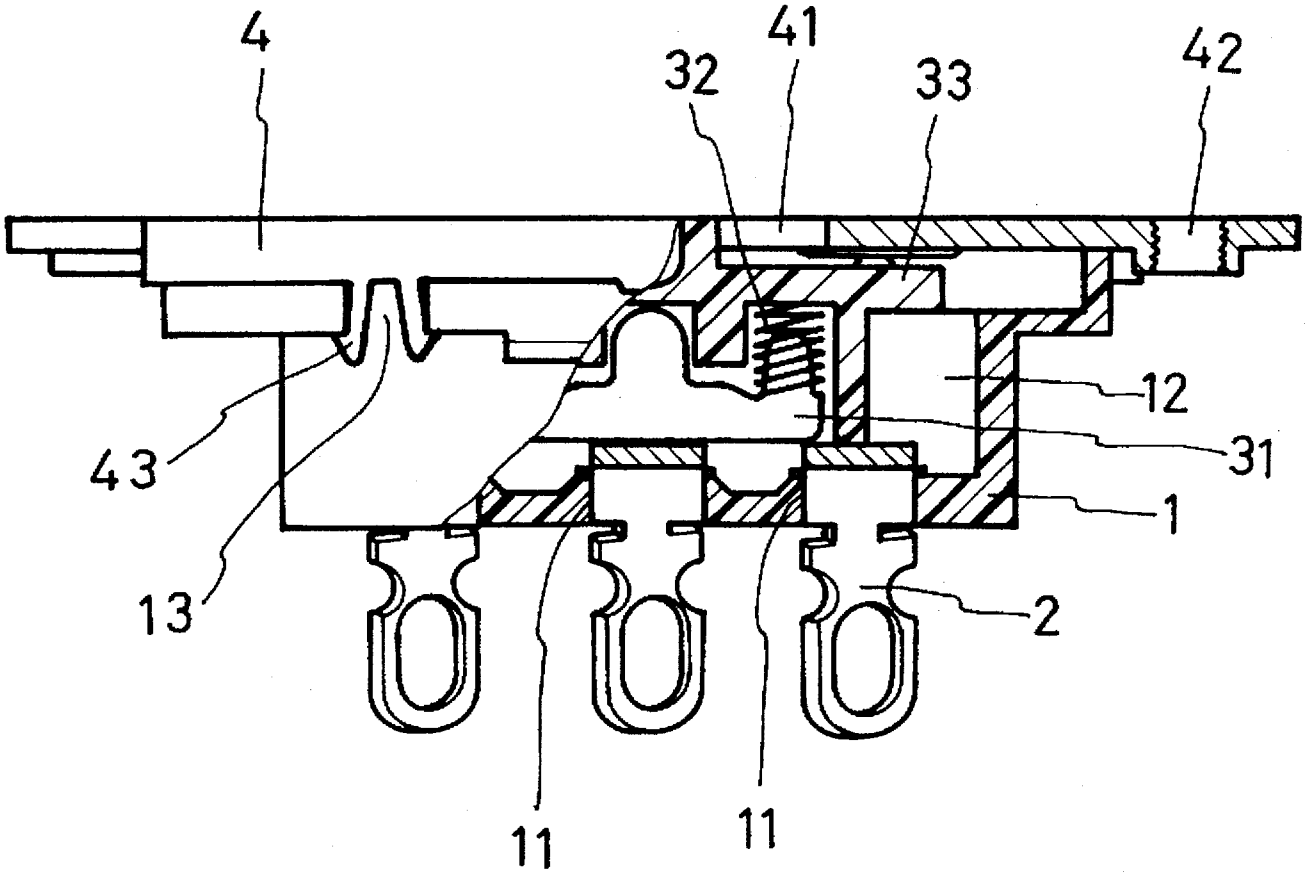
FIG. 2 is a sectional assembly view of the voltage switch shown in FIG. 1.
Figure 3:
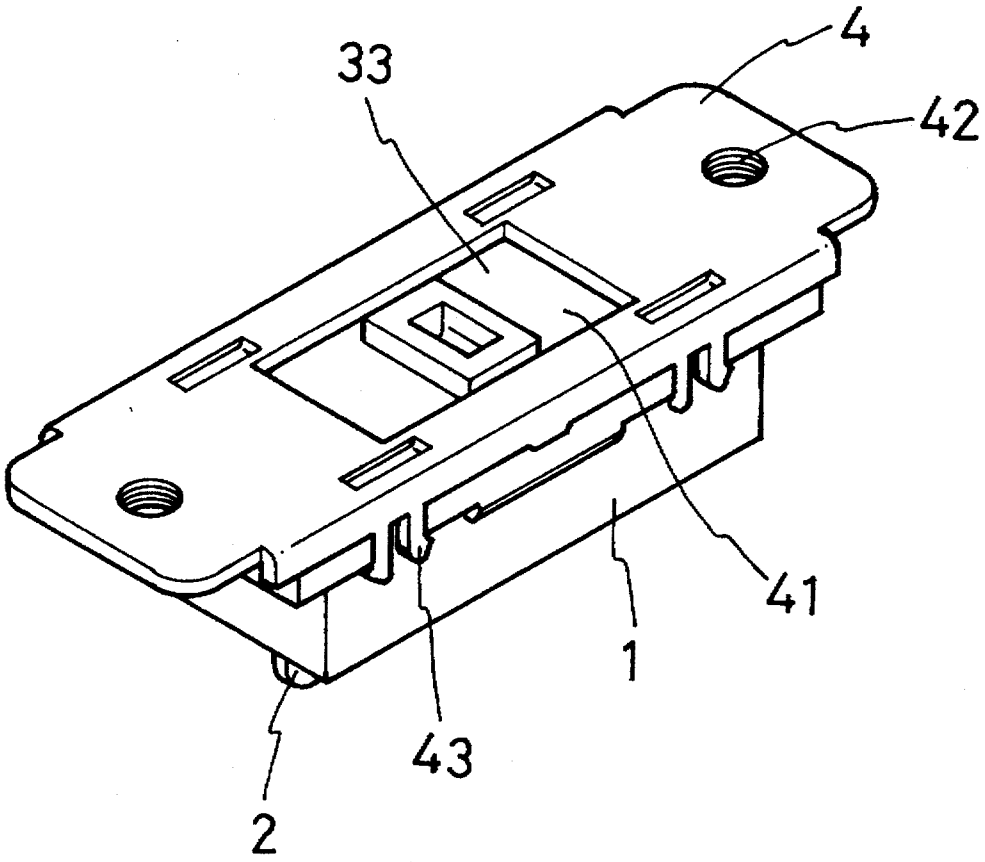
FIG. 3 is an elevational view of the voltage switch shown in FIG. 1.

Referring to FIGS. 2 and 3, when the terminals 2 are respectively fastened to the terminal slots 11 inside the casing 1, the contact slide 3 is mounted within the open chamber 12 of the casing 1, and then the bottom board 4 is covered on the casing 1 over the contact slide 3 and secured in place by fastening the upright hooks 43 to the mounting grooves 13. By means of the mounting screw holes 42, the voltage switch can be fastened to a computer. When installed, slide body 33 of the contact slide 3 can be moved within the center opening 41 to change the connection of the circuit subject to the desired voltage level.

The present invention has been approved in conformity with VDE (Germany), NEMKO (Norway), DENKO (Denmark), and FI (Finland) specifications (related certificates are available for verification upon request).

It is to be understood that the drawings are designed for purposes of illustration only, and are not intended as a definition of the limits and scope of the invention disclosed.

I claim:

1. A voltage switch comprising a casing, a plurality of terminals fastened to said casing, a bottom board covered on said casing and having a center opening, a contact slide mounted in said casing and moved within the center opening of said bottom board to alternatively connect said terminals together, wherein said casing has a plurality of mounting grooves symmetrical disposed on opposite sides each of the mounting grooves having an opening dimension; said bottom board is stamped from a metal plate and then bent into shape, having two screw holes longitudinally aligned at two opposite ends for mounting, and a plurality of hooks extending symmetrically and transversely aligned from opposite sides of the bottom board, each hook having a maximum dimension greater than the opening dimension of the mounting grooves such that engagement of the hooks with a portion of the casing adjacent to the mounting grooves secures the bottom board to said casing.

2. The voltage switch of claim 1 wherein each of said upright hooks comprises a plurality of hooked portions respectively hooked in one mounting groove of said casing.

* * * * *